United States Patent [19]

Thorsen et al.

[11] Patent Number: 4,575,596

[45] Date of Patent: Mar. 11, 1986

[54] SNAP SWITCH

[75] Inventors: Niels P. Thorsen, Horuphav; Per Andersen, Nordborg, both of Denmark

[73] Assignee: Danfoss A/S, Nordborg, Denmark

[21] Appl. No.: 675,027

[22] Filed: Nov. 26, 1984

Related U.S. Application Data

[63] Continuation of Ser. No. 538,112, Oct. 3, 1983, abandoned.

[30] Foreign Application Priority Data

Oct. 22, 1982 [DE] Fed. Rep. of Germany ..... 3239079

[51] Int. Cl.[4] ..... H01H 5/18

[52] U.S. Cl. ..... 200/67 D

[58] Field of Search ..... 200/67 D, 67 DB

[56] References Cited

U.S. PATENT DOCUMENTS 3,135,841 6/1964 Miller ..... 200/67 D 3,291,931 12/1966 Rogers ..... 200/67 D 3,662,132 5/1972 Good ..... 200/67 D 4,169,971 10/1979 Smith et al. ..... 200/67 D

*Primary Examiner*—Stephen Marcus

*Assistant Examiner*—Renee S. Kidorf

*Attorney, Agent, or Firm*—Wayne B. Easton

[57] ABSTRACT

The invention relates to a toggle type snap switch having an operating arm and a switching arm with a toggle spring hingedly connected between these arms. In one embodiment of the invention the toggle spring is in the form of a plate with a window in one end thereof. The switching arm has separate, relatively moveable snap arm and switching arm sections and a hinge connection is provided between the toggle spring and the switching arm section. The window in the toggle spring has upper and lower edges alternately abuttingly engageable with the free end of the snap arm section for opposite snap positions of the operating arm. The window may have laterally extended slot sections to form a part of the hinge connection between the toggle spring and the switching arm section.

5 Claims, 5 Drawing Figures

SNAP SWITCH

This application is a continuation of application Ser. No. 538,112, filed Oct. 3, 1983, now abandoned.

The invention relates to a snap switch with a snap arm, an operating arm and a toggle spring connected thereto by hinges, and a switching arm which extends closely adjacent to the snap arm and, on movement of the snap arm, can be carried along by two oppositely acting abutments.

In a known snap switch of this kind, the switching arm carries a movable contact which co-operates with a contact fixed with respect to the housing. The switching arm and operating arm are metal strips secured at one end to the housing. The snap arm is pivotally mounted to the switching arm near the clamping end. To form the first abutment, sheet metal embossing is provided in the zone of the contact. To form the second contact, the snap arm is provided with a step-like bend near the toggle spring for co-operating with the free end of the switching arm. The respective limiting positions of the snap system are determined on the one hand by abutment of the movable contact with the fixed contact and on the other hand by abutment of the snap arm with an adjustable abutment fixed with respect to the housing.

Such a snap switch has the advantage that the force with which the switching arm is held in its two limiting positions and thus also the contact pressure up to the instant of switching over has a predetermined minimum value, i.e. it does not drop to zero. For operating the snap switch and the aforementioned minimum force, the position of the two abutments is of considerable importance. The sheet metal embossing and step-like bending make it difficult to maintain accurate dimensions. For this reason there are errors in tolerance which become marked particularly in the case of mass production.

The invention is therefore based on the problem of providing a snap switch of the aforementioned kind wherein tolerance errors caused by the position of the abutments are substantially eliminated.

This problem is solved according to the invention in that the free end of the switching arm projects into a window at the end of the toggle spring so that the opposed window edges from the abutments.

The window can be stamped out very accurately. Consequently, the two window edges have an accurately defined spacing from each other. Manufacture is very simple, cheap and accurate. The abutments are no longer on the snap arm. However, since the snap arm is connected to the toggle spring by a hinge, the window has an accurate relationship to the snap arm.

With a toggle spring formed by a bent sheet metal strip, the window may be provided directly in the resilient strip. No additional constructional component will then be required for the window.

It is, however, also possible to use a helical spring for the toggle spring if the window is provided in a supporting plate.

It is particularly favourable if the window has two lateral extensions of shallow height in which there engage two hinge members of the snap arm disposed at both sides of the end of the switching arm. The window and hinge edges are produced in a single stamping step. In addition, tolerance problems are eliminated with regard to association of the window and hinge.

It is particularly favourable if the hinge members are interconnected beyond the end of the switching arm. This results in such strengthening of the hinge members that comparatively narrow hinge members will suffice.

A further simplification is obtained if the snap arm is made in one piece with the switching arm and has two partial arms extending at both sides thereof. In this way, tolerance problems are also avoided that arise from different mountings of the snap arm and switching arm.

In a further embodiment, a sheet metal strip may comprise a spring section which is common to the snap arm and switching arm. Based on the recognition that comparatively small relative movements between the snap arm and switching arm suffice to achieve the described advantages, one obtains under otherwise same conditions a structural component with which comparatively large forces, including large contact pressures can be taken up. The common spring section leads to increased stiffness and the shorter length of the switching arm and snap arm in the zones not common to both likewise leads to a certain amount of stiffness.

The invention will not be described in more detail with reference to a preferred example illustrated in the drawing, wherein.

Figures 1, 2, 3, 4, 5:
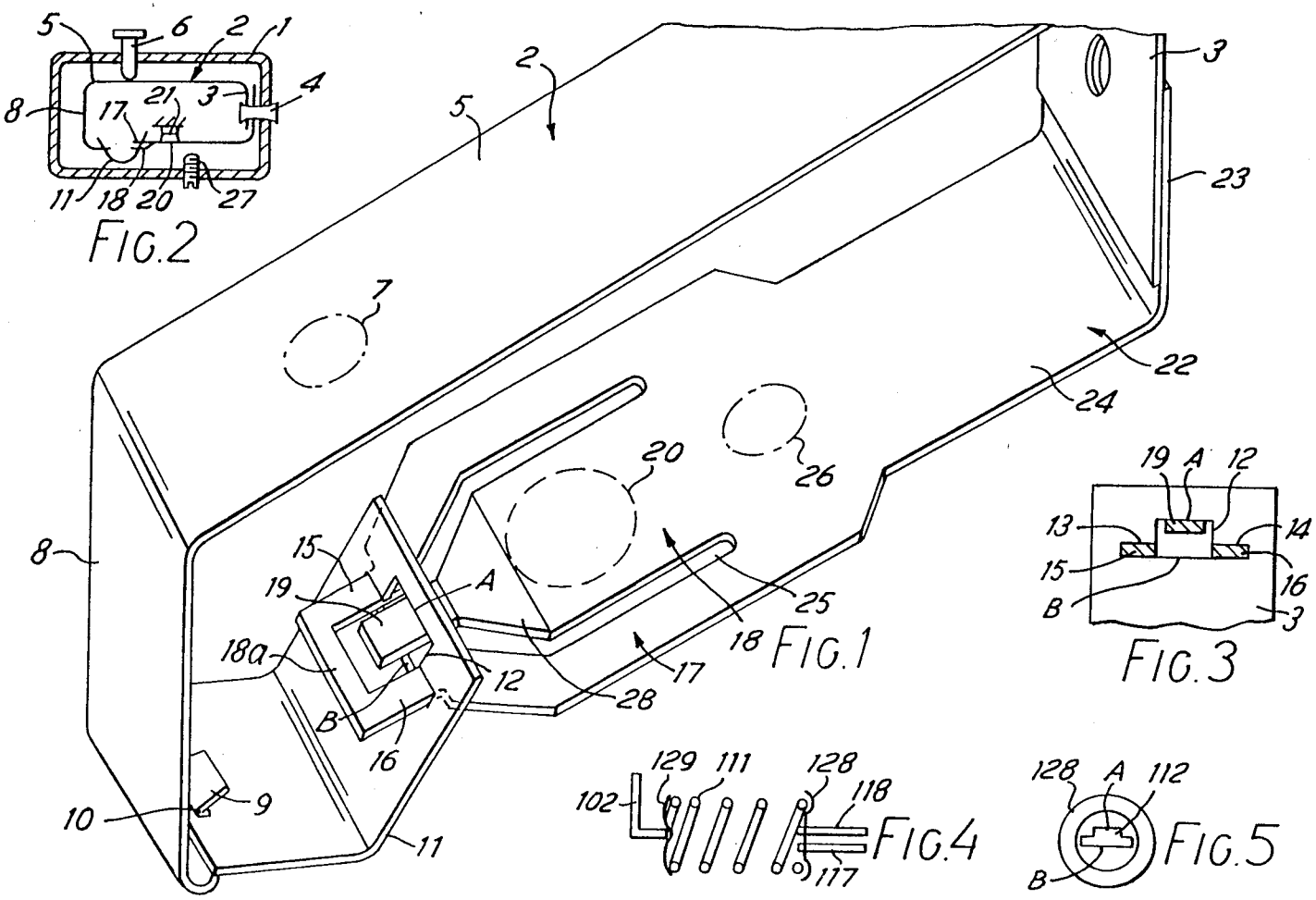
FIG. 1 is a perspective view of the important components of a snap switch according to the invention.
FIG. 2 is a diagrammatic side elevation of the switch in its housing.
FIG. 3 is a section parallel to the window zone of the toggle spring.
FIG. 4 shows the toggle spring region of another embodiment.
FIG. 5 is a plan view of the right-hand supporting plate of FIG. 4.

The snap switch of FIGS. 1 to 3 comprises a housing 1 containing an operating arm 2 which, by its flanged end 3 and by means of a rivet 4 or the like, is secured to the housing 1, can be loaded by an operating element 6 at the region 7 of its longitudinal web 5, and carries at its flanged end portion 8 a hinge member 9 which engages through a slot 10 in a bent toggle spring 11.

At the other end region of the toggle spring 11, there is a window 12 having two lateral extensions 13 and 14. Two hinge members 15 and 16 of a snap arm 17 that are interconnected by a web 18 a at the free end engage in the lateral extensions 13 and 14 so that a hinge is produced between the toggle spring 11 and snap arm 17. In the central zone of the window, two abutments A and B are formed between which the end 19 of a switching arm 18 can be reciprocated. The switching arm 18 carries a movable contact 20 which can co-operate with a contact 21 fixed with respect to the housing.

The snap arm 17 and switching arm 18 are parts of a common resilient sheet metal plate or switching member 22 of which the bent end portion 23 is secured to the housing 1 with the aid of the rivet 4 or the like. This merges with a common resilient section 24. There then commences a slot-like stamped recess 25 by which the snap arm 17 and switching arm 18 are separated from each other. An adjusting device 27 engages in the region 26 of the common resilient section to provide a limiting downward position for the section 24.

The production of the components of the snap system is very simple. It is merely necessary to stamp out and bend resilient sheet metal strips. Since the window 12 does not only have the two abutments A and B but, by reason of the extensions 13 and 14, also fixes the position of the hinge portions 15 and 16 at the toggle spring 11, the abutments have a defined position in relation to the snap arm 17 and a defined spacing from each other. Because of the one-piece construction, the switching arm 18 and snap arm 17 also have a clearly defined position with respect to each other.

In the present case, the abutment B is flush with the lower edge of the lateral extensions 13 and 14, which simplifies the construction of the stamping tool. For this reason, the end 19 is offset from the plane of the remainder of the switching arm 18 by a bend 28. However, one can also leave the entire switching arm 18 in the same plane and dispose the abutments A and B above and below the extensions 13 and 14 16.

In operation, the operating arm 2 assumes a position of equilibrium which depends on the one hand on the force applied through the operating element 6 and on the other hand on the elastic return force of the operating arm. If, starting with the illustrated position of the snap system with switching arm 19 engaging window edge A, the operating force via operating element 6 is reduced and the operating arm 2 is displaced upwardly, snapping over takes place up to abutment of the sheet metal strip or switching member 22 against the adjusting device 27 and arm end 19 engaging window edge B as soon as the hinge members 9 and 15, 16 pass through the dead centre position. Until snapping over takes place, a predetermined minimum contact pressure is maintained. In the reverse direction of operation, the conditions are similar.

In the basic toggling action the limiting abutments for the operating arm 2 and the snap arm 17 are the operating element 6 and the adjustment device 27. If these limiting abutments were also the limiting abutments for the moveable contact 20, there would be serious tolerance problems caused by the difficulty involved in accurately positioning the abutments 6 and 27 in the manufacturing process.

As disclosed herein the corresponding limiting abutments are the edges A and B of the window 12 in the toggle spring 11. The window 12 can be stamped out very accurately so that the edges A and B can be accurately spaced from each other.

With the basic toggling action taken care of by the action between toggle spring 11 and snap arm 17, the switching arm 18 is dedicated to and restricted to the function of precisely opening and closing the contacts 20, 21 in synchronism with the toggling by the alternate engagement of the switch arm tab 19 with the window edges A and B. Preciseness of operation is achieved by reason of the comparatively small relative movements between the snap arm 17 and switching arm 18 afforded by a form of lost motion connection between tab 19 and the window edges A and B.

In the FIGS. 4 and 5 embodiment, reference numerals increased by 100 have been used for corresponding components. A helical spring serves as the toggle spring 111. On the right-hand side there is provided a supporting plate 128 with a window 112 in which the snap arm 117 and switching arm 118 can engage. On the left-hand side there is a supporting plate 129 forming a bearing for the operating arm 2.

When used as a thermostatic switch, particularly as a thermostat for refrigerators, the operating element is loaded in response to the temperature. The switching temperature can be accurately adjusted with the aid of the adjusting device 27. By reason of the accurate spacing between the abutments A and B, even with mass production, comparatively small temperature differences can be set.

We claim:

1. A snap switch unit, comprising, a casing, fixed and moveable contacts with said fixed contact connected to said casing, an operating arm having fixed and free ends with said fixed end thereof hingedly connected to said casing, a resilient switching member having fixed and free ends with said fixed end thereof hingedly connected to said casing, said fixed ends of said operating arm and said switching member being in juxtaposition, said switching member having relatively moveable switching arm and snap arm sections with free ends in juxtaposition, said moveable contact being on said switching arm section, toggle spring means for toggling said switching member in response to movement of said operating arm, said toggle spring means being hingedly connected to said free end of said operating arm and having a hinge connection with said free end of said snap arm section, stop means connected to said casing for limiting one snap position of said switching member, said toggle spring means having a window with upper and lower edges alternately abuttingly engageable with said free end of said switching arm section corresponding to open and closed conditions of said contacts and being for opposite snap positions of said operating arm, said switching arm being dedicated to and restricted to opening and closing said contacts in synchronism with said toggling by the alternate engagement of said switching arm section with said window edges, there being a lost motion connection between said switching arm section and said window edges.

2. A snap switch unit according to claim 1 wherein said toggle spring is in the form of a bent metal strip.

3. A snap switch unit according to claim 1 wherein said toggle spring means includes a helical spring and a plate having one side thereof abutting said helical spring and the other side thereof abutting said free ends of said switching arm and snap arm sections, said window being formed in said plate.

4. A snap switch unit according to claim 1 wherein said switching arm section has one portion thereof alternately engageable with said window upper and lower edge and said snap arm section has two parallel portions in engagement with said window lower edge.

5. A snap switch unit according to claim 4 wherein said two parallel portions are connected beyond the end of said one portion of said switching arm section.

* * * * *